US009733607B2

(12) United States Patent
Matsumoto et al.

(10) Patent No.: US 9,733,607 B2
(45) Date of Patent: Aug. 15, 2017

(54) TONER CONVEYANCE DEVICE AND IMAGE FORMING APPARATUS

(71) Applicants: Kazuki Matsumoto, Osaka (JP); Naoki Nakatake, Hyogo (JP); Emi Kita, Kanagawa (JP); Mitsutoshi Kichise, Osaka (JP)

(72) Inventors: Kazuki Matsumoto, Osaka (JP); Naoki Nakatake, Hyogo (JP); Emi Kita, Kanagawa (JP); Mitsutoshi Kichise, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/158,025

(22) Filed: May 18, 2016

(65) Prior Publication Data

US 2016/0342129 A1 Nov. 24, 2016

(30) Foreign Application Priority Data

May 18, 2015 (JP) ..... 2015-100866
Aug. 19, 2015 (JP) ..... 2015-161800

(51) Int. Cl.
*G03G 21/00* (2006.01)
*G03G 21/10* (2006.01)

(52) U.S. Cl.
CPC ..... *G03G 21/0011* (2013.01); *G03G 21/105* (2013.01); *G03G 2215/0132* (2013.01); *G03G 2221/001* (2013.01)

(58) Field of Classification Search
CPC ..... G03G 21/0011; G03G 21/105
USPC ..... 399/358, 359, 360
See application file for complete search history.

(56) References Cited

U.S. PATENT DOCUMENTS

2008/0056771 A1* 3/2008 Chatani ..... G03G 15/0893 399/253
2008/0310896 A1 12/2008 Shono et al.
2009/0238617 A1 9/2009 Nakatake et al.
2010/0143011 A1 6/2010 Tawada et al.
2014/0356043 A1* 12/2014 Tokuda ..... G03G 21/105 399/358
2015/0063887 A1 3/2015 Asaoka et al.

FOREIGN PATENT DOCUMENTS

JP 2010-066318 3/2010
JP 2010-156938 7/2010

* cited by examiner

*Primary Examiner* — Sandra Brase
(74) *Attorney, Agent, or Firm* — Oblon, McClelland, Maier & Neustadt, L.L.P.

(57) ABSTRACT

A cleaning device in accordance with the present disclosure includes a cleaning member to clean toner on an image bearer, a toner conveyor that rotates to convey toner cleaned by the cleaning member, and an agitator that includes a bent portion that is in contact with the toner conveyor, and the agitator vibrates due to the rotation of the toner conveyor. The agitator includes a plurality of arm members, and a first end of a first arm member of the plurality of arm members is attached to a second end of a second arm member of the plurality of arm members.

20 Claims, 12 Drawing Sheets

TONER CONVEYANCE DEVICE AND IMAGE FORMING APPARATUS

CROSS-REFERENCE TO RELATED APPLICATIONS

This patent application is based on and claims priority under 35 U.S.C. §119(a) to Japanese Patent Application No. 2015-100866, filed in Japan on May 18, 2015, and Japanese Patent Application No. 2015-161800, filed in Japan on Aug. 19, 2015, and the disclosure of each is hereby incorporated by reference in their entirety.

BACKGROUND

Technical Field

Embodiments of the present application generally relate to a cleaning device and an image forming apparatus, such as, a copier, a printer, a facsimile machine, a plotter, or a multifunction peripheral (MFP) device including a toner conveyance device.

Description of the Related Art

Typically, an electrostatic latent image formed on a photoconductor as an image bearer is visualized as a toner image by a developing device. The toner image is transferred to a transfer material such as paper, and fixed as a visualized image in an image forming apparatuses such as printers, copiers, facsimile machines, and MFTs having those capabilities. An un-transferred toner on the photoconductor is leaned from the photoconductor by a cleaning blade which contacts to the photoconductor and conveyed to the developing device or a waste toner container by a conveyance member such as a screw or a coil.

As image forming apparatuses are being made smaller, a temperature in the image forming apparatus is increased, which deteriorates a fluidity of toner used in the image forming apparatus. As fluidity deteriorates, enhancing an ability of toner conveyance is desired. Waste toner, which is collected and stored, is agitated and cultivated by an agitator made of elastic plate with rotation of the conveyance member in order to prevent toner from clogging in the conveyance path. A free end of the agitator is arranged in an area around the conveyance member where the waste toner is accumulated. Thereby the stored waste toner is agitated and cultivated by the agitator.

Further, image forming apparatuses may include a plurality of scraping pieces or arm members at an end of the agitator. The agitator is vibrated by interlocking with the driving of the conveyance member.

SUMMARY

A cleaning device in accordance with the present disclosure comprises a cleaning member to clean toner on an image bearer, a toner conveyance to convey toner cleaned by the cleaning member, and an agitator that vibrate due to rotation of the toner conveyance, the agitator including a bent portion which is to contact to the toner conveyance.

BRIEF DESCRIPTION OF THE DRAWINGS

The accompanying drawings are included to provide further understanding of the invention, and are incorporated in and constitute a part of this specification. The drawings illustrate embodiments of the invention and, together with the specification, serve to explain the principle of the invention.

DETAILED DESCRIPTION

Embodiments of the present disclosure are described below with reference to the accompanying drawings. However, the disclosure of this patent specification is not intended to be limited to the specific terminology so selected, and it is to be understood that each specific element includes all technical equivalents that operate in a similar manner and achieve a similar result.

In a cleaning device which includes an agitator having a plate-shaped piece at an end of the agitator, there is a possibility that the plate-shaped piece is deformed, which may reduce the vibration of the agitator. A reduction in the vibration of the agitator may then lead to toner clogging of the toner bridge. Further, deformation of the agitator may lead to toner leakage onto a transfer material.

Embodiment of the present application may reduce occurrence of the toner bridge and toner clogging.

Figure 1:
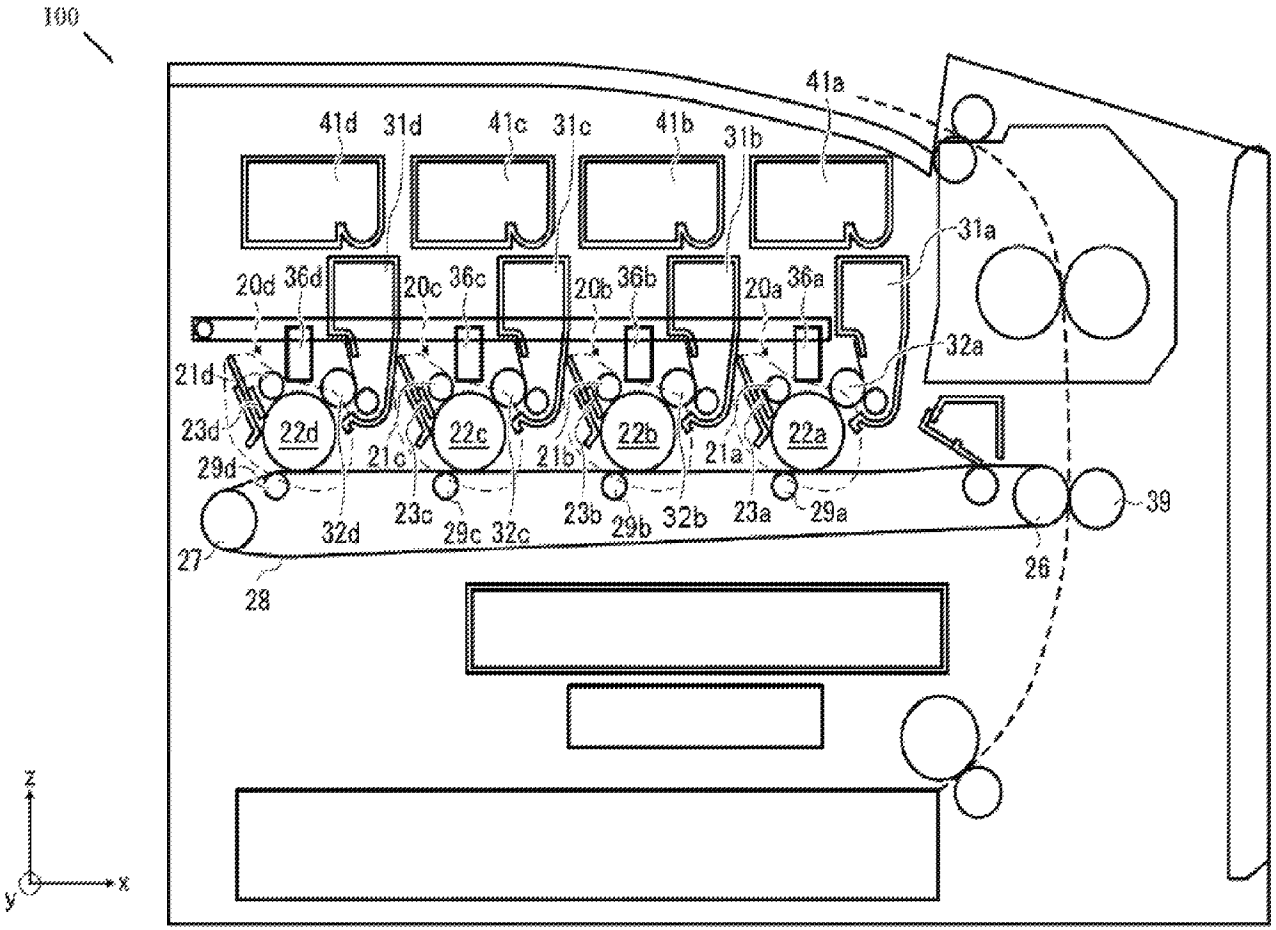
FIG. 1 illustrates a schematic view of an exemplary image forming apparatus in accordance with the present application.
Figure 2:
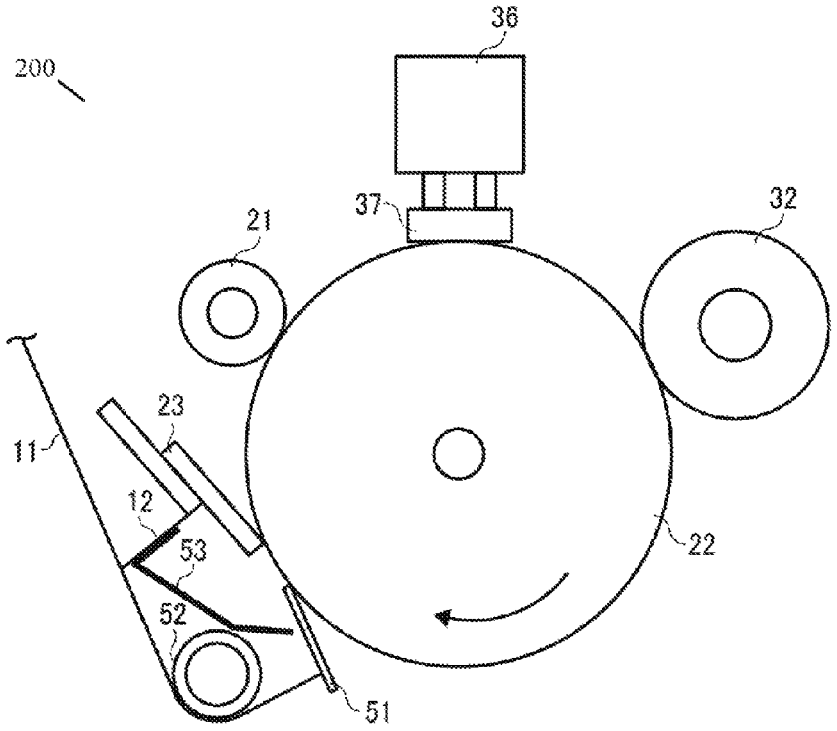
FIG. 2 illustrates a schematic cross-sectional view of a process cartridge.

Referring now to the drawings, wherein like reference numerals designate identical or corresponding parts throughout the several views thereof. Referring to FIGS. 1 and 2, FIG. 1 illustrates a schematic view of an exemplary image forming apparatus in accordance with the present application. FIG. 2 illustrates a schematic cross-sectional view of a process cartridge.

Image forming apparatus 100 is a tandem type apparatus including a developing unit arranged around a photoconductor as an image bearer, a toner cartridge arranged above the developing unit, and four image forming sections. FIG. 1 illustrates image forming apparatus 100 in a state in which a process cartridge (element 200 as illustrated in FIG. 2) including the developing unit and the photoconductor unit is attached to an apparatus main body. Process cartridge 200 may be housed in a housing that is detachable from the apparatus main body.

Image forming apparatus 100 includes four toner cartridges 41 (41*a*, 41*b*, 41*c* and 41*d*), developing units 31 (31*a*, 31*b*, 31*c* and 31*d*) and photoconductors 22 (22*a*, 22*b*, 22*c*, and 22*d*) combined to the developing units 31 for respective colors (yellow, magenta, cyan and black). FIG. 1 includes reference characters a, b, c and d, which represent respective colors, and are omitted in the below explanation.

Cleaning blade 23 (23*a*, 23*b*, 23*c* and 23*d*) is a cleaning member which cleans un-transferred toner after a primary transfer process is performed. Charging roller 21 (21*a*, 21*b*, 21*c* and 21*d*) is a charger which is in contact with the photoconductor 22 and charging roller 21 is arranged around the photoconductor 22. Photoconductor unit 20 (20*a*, 20*b*, 20*c* and 20*d*) includes charging roller 21 and photoconductor 22. Optical writing head 36 (36*a*, 36*b*, 36*c* and 36*d*) has an LED, and the optical writing head 36 exposes the photoconductor 22.

An intermediate transfer unit includes an intermediate transfer belt 28, a driving roller 26 and a driven roller 27. The intermediate transfer belt 28 contacts and separates from the photoconductors 22, and intermediate transfer belt 28 is stretched and moves between the driving roller 26 and the driven roller 27. A primary transfer roller 29 (29*a*, 29*b*, 29*c* and 29*d*) is arranged so as to oppose to each of the photoconductors 22*a*, 22*b*, 22*c* and 22*d* via the intermediate transfer belt 28.

A bias voltage of negative potential is applied from a bias power to a core bar of developing roller 3 (32*a*, 32*b*, 32*c* and 32*d*), which are each respectively a part of the developing unit 31 (31*a*, 31*b*, 31*c* and 31*d*). The bias voltage of negative potential of direct current is applied from the other bias power to each of the charging roller 21. An image forming part includes the developing unit 31, the photoconductor 22, the cleaning blade 23 and the charging roller 21.

Image forming apparatus 100 further includes each image part 20 for a respective color, and with image parts 20 it is possible to form a color image. For example, in the first image forming part 20*a*, the cleaning blade 23*a* cleans un-transferred toner which remains on a surface of the photoconductor 22*a*. The charging roller 21*a* charges the surface of the photoconductor 22*a* to initialize and make uniform a high potential. LED of the optical writing head 36*a* selectively exposes the photoconductor 22*a* based on the image data. Thereby, an electrostatic latent image comprising a low-potential part whose potential is attenuated by exposure and a high-potential part by initialized is formed onto the surface of the photoconductor 22*a* which is charged to a uniform high potential.

The developing unit 31*a* forms the toner image by transferring the toner to the low-potential part of the electrostatic latent image. The photoconductor 22*a* transfers the toner to the intermediate transfer belt 28 by rotationally conveying the toner image. The second image forming part 20*b*, the third image forming part 20*c* and the forth image forming part 20*d* each perform the same as first image forming part 20*a*, thereby generating and conveying a composed color image, which is transferred to a recording medium, such as paper, which is conveyed to second transfer part by a second transfer roller 39.

FIG. 2 shows an arrangement of main parts of process cartridge 200. Process cartridge 200 supports the photoconductor and at least one kind of device selected from a group of a charging device, a developing device and a cleaning device as integrated. Process cartridge 200 may be attached to and detached from image forming apparatus 100 so as to change the device in accordance with a replacement life of the process cartridge 200. In this embodiment, the process cartridge 200 includes the photoconductor unit 20 and the developing unit 31.

Referring to FIG. 2, the cleaning blade 23, the charging roller 21, the optical writing head 36 via the spacer 37 and the developing roller 32 are arranged along a rotational direction of the photoconductor 22 in a case 11 of process cartridge 200. In particular, a surface of the photoconductor 22 to which the un-transferred toner adheres is rotated so as to be close to the cleaning blade 23 from the lower side and to be removed by cleaning blade 23.

When the waste toner is collected, there may be two types of arrangement. In a first arrangement, the surface of the photoconductor 22 rotates so as to be close to the cleaning blade 23 from upper side. In a second arrangement, the surface of the photoconductor 22 rotates no as to be close to the cleaning blade 23 from lower side. In the first arrangement, the un-transferred toner is cleaned from the photoconductor 22 by the cleaning blade 23 and the toner accumulates in a back side of the cleaning blade 23 (i.e., the opposite side of the photoconductor 22). Since a free end of the agitator 53 is arranged between the cleaning blade 23 and conveyance 52, the agitator 53 is vibrated, and the accumulated toner is loosened and agitated. Thereby it is possible to enhance an ability of conveying the toner via conveyance 52.

On the other hand, in the first arrangement in which the surface of the photoconductor 22 rotates no as to be close to the cleaning blade 23 from the upper side, the operability is poor because the transfer part is arranged above the process cartridge 200, and the process cartridge 200 is detached from only horizontal direction in exchanging the process cartridge 200. It is impossible to detach the process cartridge 200 from the image forming apparatus 100 in vertical direction.

In the second arrangement, the surface of the photoconductor 22 rotates so as to be close to the cleaning blade 23 from lower side. The process cartridge 200 is detachable from the upper side of the image forming apparatus 100 by arranging the transfer part below the process cartridge.

In the arrangement, un-transferred toner which cleaned from the photoconductor 22 by the cleaning blade 23 falls in direction of gravity. The un-transferred toner accumulates between the conveyance 52 and a seal 51. The seal is attached to the cartridge case 11 so as to prevent the waste toner, which is stored inside a waste toner containing part of the cleaning device, from leaking.

Un-transferred toner is conveyed to the collecting container outside the process cartridge by the conveyance 52 with being loosed and agitated by the agitator 53. The shape of the conveyance 52 may be a spiral such as screw type or coil type so as to convey toner smoothly.

Figure 3A:
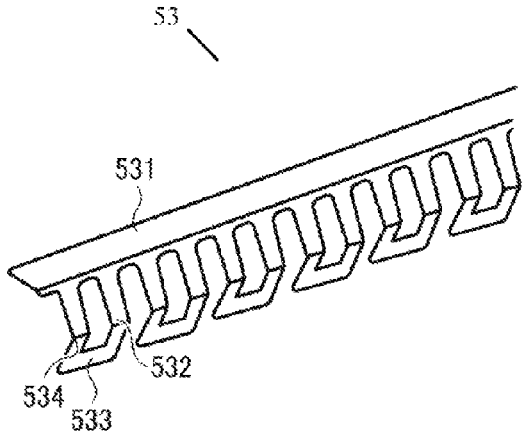
FIG. 3A illustrates a perspective view of an exemplary agitator.
Figure 3B:
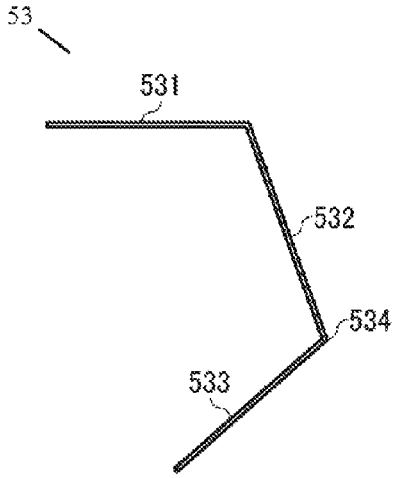
FIG. 3B illustrates a side view of agitator illustrated in FIG. 3A.

FIG. 3A illustrates a perspective view of agitator 53 and FIG. 3B illustrates a side view of agitator 53. The agitator 53 includes three surfaces, which are a first surface 531, second surface 532 and third surface 533. The first surface 531 is an attachment part that attaches to an upper surface 12 of the waste toner conveyance path at the process cartridge case 11. The second surface 532 is calm-shaped and bent from the first surface 531. The third surface 533 is bent from an end of the calm-shaped of the second surface 532, and vibrated by rotating the conveyance 52. A bent part 534 is arranged between the second surface 532 and the third surface 533. The agitator 53 is in contact with the conveyance 52 at the bent part 534. When the bent part 534 contacts to a spiral wing of the rotating conveyance 52, the second surface 532 and the third surface 533 vibrate and interlock with the rotation of the conveyance 52. Thereby, the vibration of agitator 53 loosens the toner.

Agitator 53 may be composed of PET (poly ethylene terephthalate). However, agitator may be composed of another elastically deformable material, such as a thin stainless plate.

Typically, in a elastically plate-shape material, the material deforms at the contact portion of the conveyance 52, which reduces a vibration of the end of an agitator. Agitator 53, however, includes the bent part 534 between the second surface 532 and the third surface 533. The bent part 534 is harder than plate-shape part. As a result, agitator 53 sufficiently vibrates when the bent part 534 is near the contact portion of the conveyance 52.

Figure 4A:
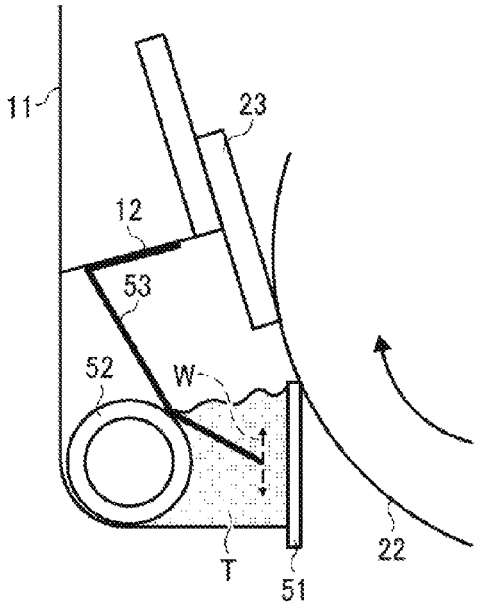
FIG. 4A illustrates a cross-sectional view of an agitator attached to a process cartridge.
Figure 4B:
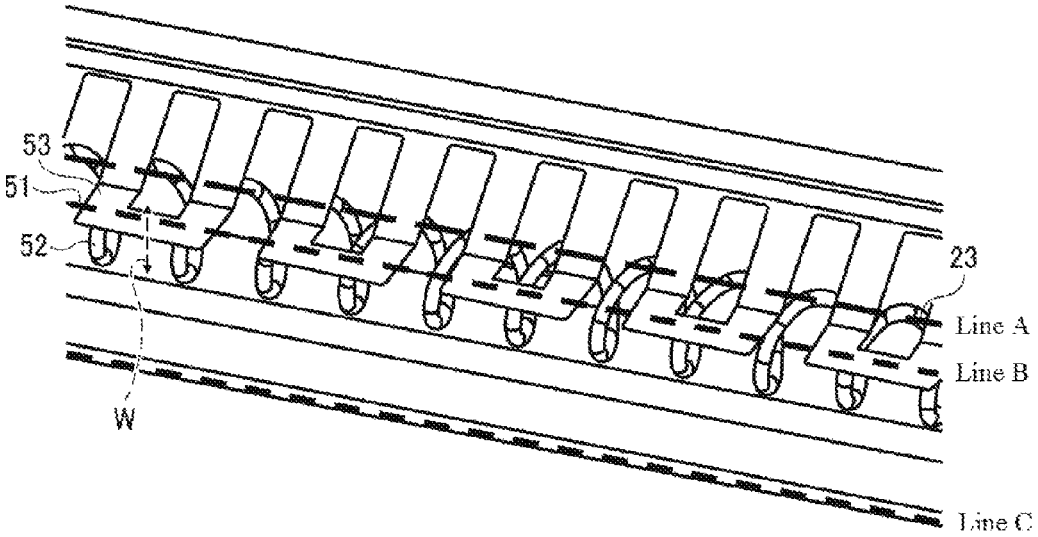
FIG. 4B illustrates a perspective view of the agitator of FIG. 4A attached to the process cartridge.

FIG. 4A illustrates a cross-sectional view of an exemplary agitator 53 attached to a process cartridge. FIG. 4B illustrates a perspective view of agitator 53 and FIG. 4C illustrates another perspective view of agitator 53.

FIG. 4B includes three broken lines, lines A, B and C. A surface of agitator 53, illustrated between lines A and B is where the cleaning blade 23 contacts the agitator 53. A space between lines B and C illustrate a configuration of the seal 51 and the agitator 53. In particular, the transfer part is below the process cartridge 200 and the process cartridge 200 is detached from the upper side, the surface of the photoconductor 22 rotates no as to be close to the cleaning blade 23 from lower side shown as FIG. 4A.

The un-transferred toner is cleaned by cleaning blade 23, from a surface of agitator 53 between lines A and B, and the toner is accumulated near a back side of the seal 51, in the area between lines B and C. The end of the agitator 53 is arranged lower than the upper end of the seal 51. Thereby, the un-transferred toner at the back side of the seal 51 is agitated and loosened by vibrating of the agitator 53. This reduces bridging of the toner. The agitated and loosened waste toner T is conveyed to the waste toner container by conveyance 52. In addition, the end of the agitator 53 is arranged at a back side of the seal 51, which reduces a likelihood of damage to the surface of the photoconductor 22 by contacting the end of the agitator 53 to the surface of the photoconductor 22.

Figure 4C:
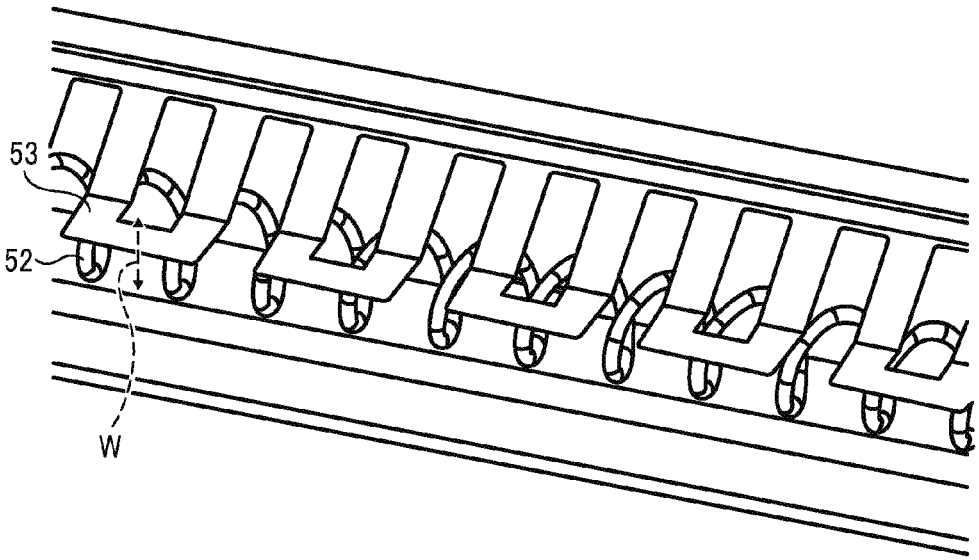
FIG. 4C illustrates a perspective view of the agitator of FIG. 4A attached to the process cartridge.

As illustrated in FIGS. 4A, 4B and 4C, the agitator 53 vibrates up and down in an area W. In particular, the agitator 53 vibrates between the spiral wing (i.e., outer peripheral part of the screw) of the conveyance 52. The agitator 53 is pushed up and returned lower by the contact with the conveyer 52. The agitator 53 moves up-and-down by rotating the conveyance 52, and the vibration agitates and loosens the waste toner. An interval between the arm members of the agitator 53 may correspond to a pitch of the spiral wing of the conveyance 52.

Modified structures of the agitator 53 are illustrated in FIGS. 5A, 5B, 6A, 6B, 7A, 7B, 8A and 8B.

Figure 5A:
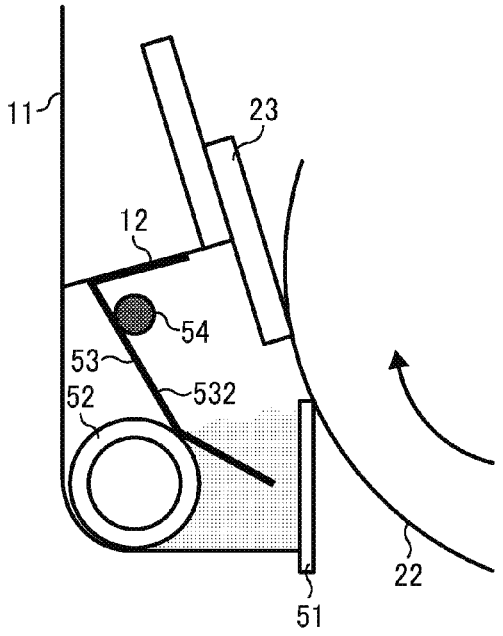
FIG. 5A illustrates a cross-sectional view of another agitator attached to a process cartridge.
Figure 5B:
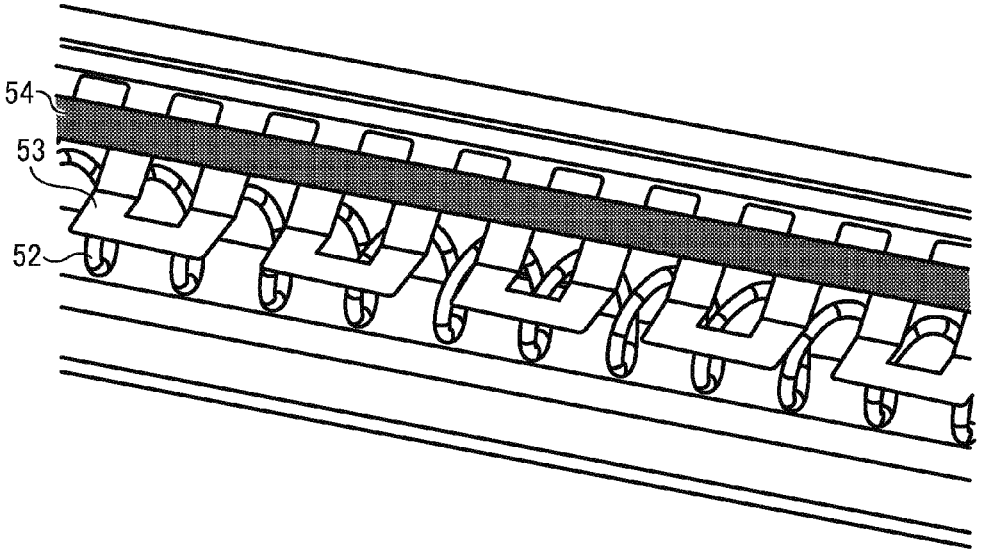
FIG. 5B illustrates a perspective view of the agitator of FIG. 5A attached to the process cartridge.

In FIGS. 5A and 5B, a positioning restrictor 54 is in contact with the second surface 532 of the agitator 53. The positioning restrictor 54 restricts the vibration of the agitator 53, and prevents the end of agitator 53 from leaping over the upper end of the seal 51. Restrictor 54 reduces a likelihood of damage to the surface of the photoconductor 22 by contacting the end of the agitator 53 to the surface of the photoconductor 22. The positioning restrictor 54 is arranged along a conveyance direction of the conveyance 52 i.e. a longitudinal direction of the waste toner conveyance path.

Figure 6A:
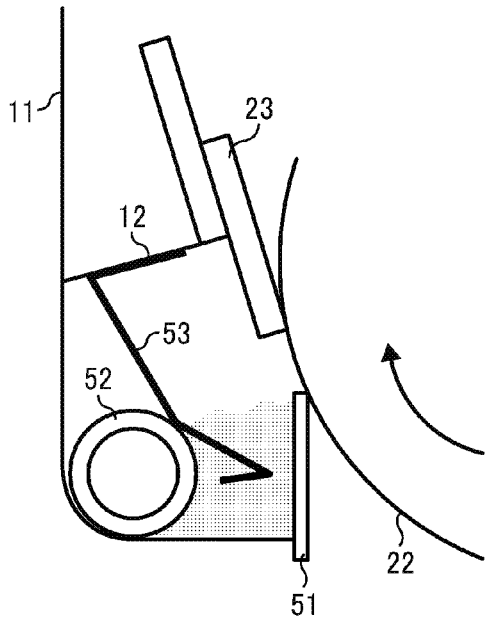
FIG. 6A illustrates a cross-sectional view of an agitator attached to a process cartridge.
Figure 6B:
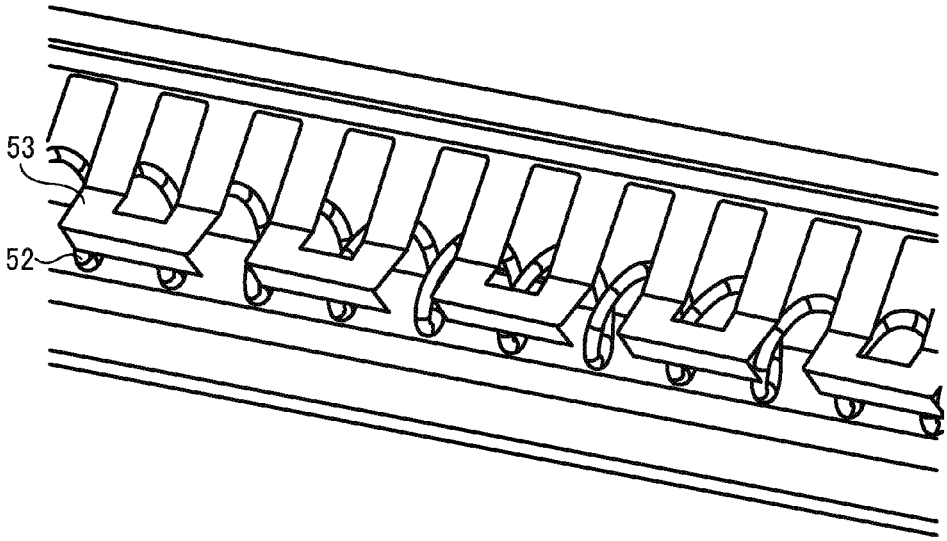
FIG. 6B illustrates a perspective view of the agitator of FIG. 6A attached to the process cartridge.

In FIGS. 6A and 6B, an end of the agitator 53 is bent toward the conveyance 52 in comparison to the attachment structure of agitator 53 as illustrated in FIGS. 4A and 4B. That is, the end of the agitator 53 is bent so as to directed away from the photoconductor 22. The end of the agitator 53 may rounded at the bent portion by bending the end of the agitator 53, which reduces a likelihood of damage to the surface of the photoconductor 22 from contact of the agitator 53 to the photoconductor 22 over the seal 51. As a result, a length of the agitator 53 is able to extend near the seal 51. In some embodiments, the agitator 53 may be bent toward the conveyance 52 and the image forming apparatus may further include the positioning restrictor 54, as illustrated in FIGS. 5A and 5B.

Figure 7A:
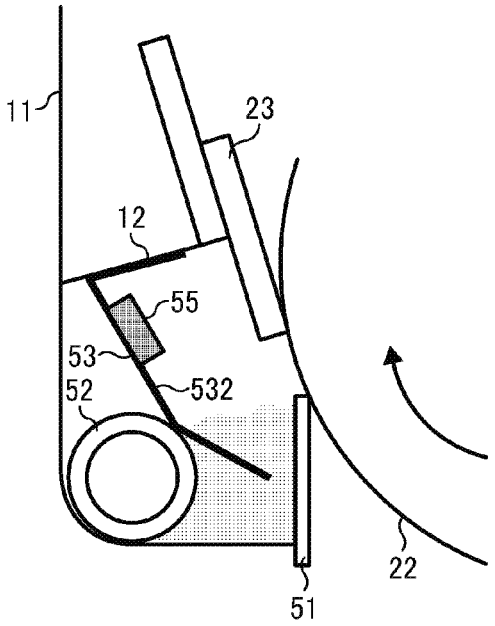
FIG. 7A illustrates a cross-sectional view of an agitator attached to a process cartridge.
Figure 7B:
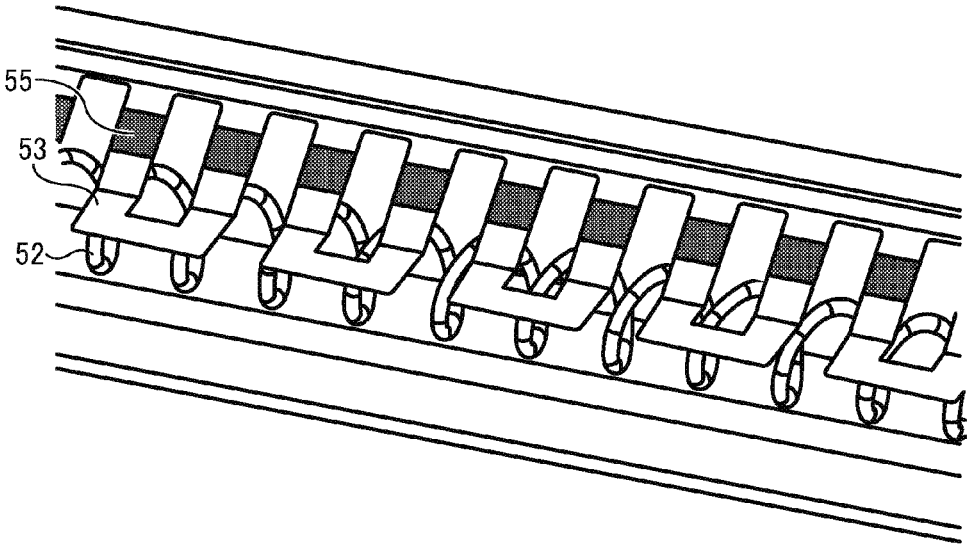
FIG. 7B illustrates a perspective view of the agitator of FIG. 7A attached to the process cartridge.

As illustrated in FIGS. 7A and 7B, a weight 55 is attached to agitator 53. The weight 55 is attached to the second surface 533 of the agitator 53, so that the agitator 53 is pressed to the conveyance 52, and the agitator 53 is in contact with the spiral wing of the conveyance 53. The weight 55 is substitutable with the positioning restrictor 54 shown in FIGS. 5A and 5B.

Figure 8A:
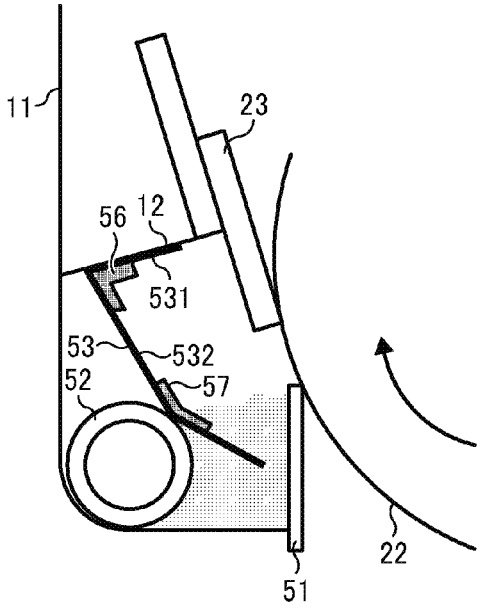
FIG. 8A illustrates a cross-sectional view of an agitator attached to a process cartridge.
Figure 8B:
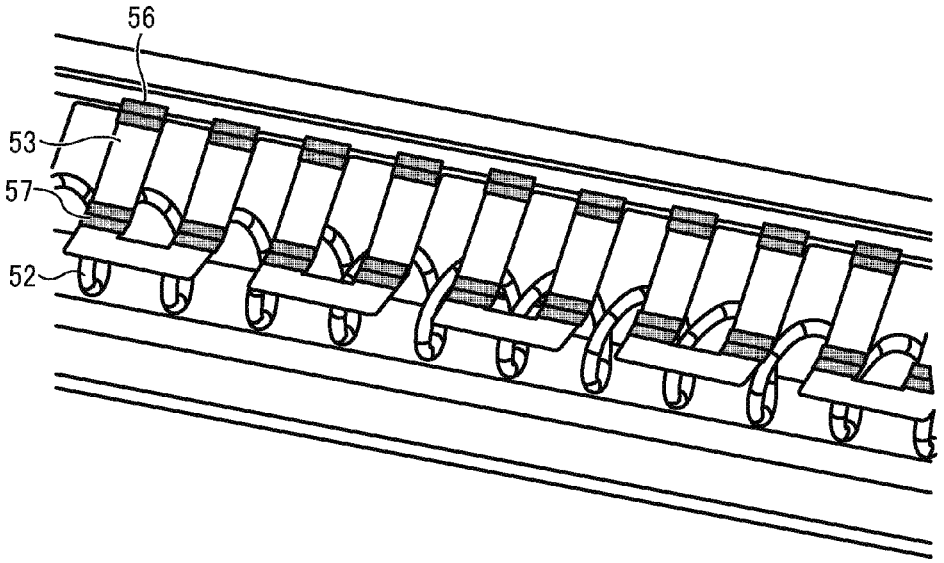
FIG. 8B illustrates a perspective view of the agitator of FIG. 8A attached to the process cartridge.

As illustrated in FIGS. 8A and 8B, the agitator 53 includes a reinforcing member 56. The reinforcing member 56 is attached to the bent portion between the first surface 531 and the second surface 532 of agitator 53. Reinforcing member 56 reinforces the bent portion of agitator 56 so that a bending angle of the agitator 53 does not fluctuate. Another reinforcing member 57 may be attached to the area (the bent part 534) in which the agitator 53 is in contact with the conveyance 52. Reinforcing member 57 further reduces a fluctuation of the bending angle of the agitator 53. Thereby, the end of the agitator 53 may be positioned at a target position. The agitator 53 may by attached to one or both of the reinforcing member 56 and 57. The reinforcing members 56 and 57 may be used in conjunction with or in place of the weight 55. In addition, the reinforcing members 56 and 57 may be used with or in place of the positioning restrictor 54. Further, the reinforcing members 56 and 57 may be utilized for an agitator 53 including the bent portion of the end of the agitator 53, as illustrated in FIGS. 6A and 6B.

In many devices, the conveyance is driven in interlock with the photoconductor by, for example, a gear connection. In such cases, when the photoconductor is rotated in a reverse direction relative to a normal direction to clean the toner at the end of cleaning member, the conveyance is also rotated in the reverse direction.

Figure 9:
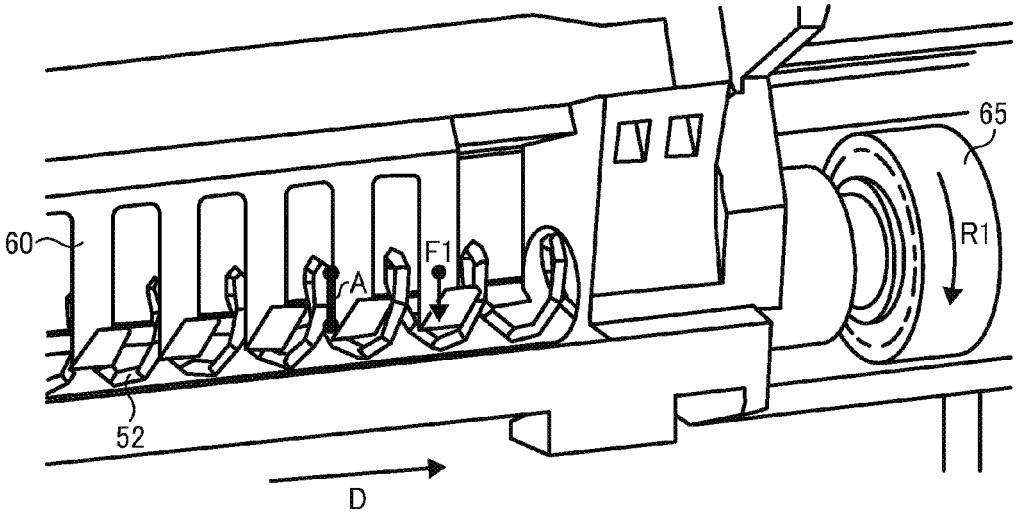
FIG. 9 illustrates a perspective view of an agitator and a conveyance under an external force acting on a contact portion between the agitator and the conveyance.

FIG. 9 illustrates a perspective view of an agitator and a conveyance under an external force acting on a contact portion between the agitator and the conveyance. In particular, FIG. 9 illustrates an external force acting on a contact portion between an agitator 60 and the conveyance 52 when the conveyance 52 rotates in a rotational direction R1.

The agitator 60 includes a plurality of arm members, and the end of agitator 60 is bent at an angle away from the arm members and conveyance 52. The conveyance 52 is connected to a gear 65, and rotates in same direction to the gear 65. When the conveyance 52 is rotated by the gear 65 in a rotational direction R1, the spiral wing of the conveyance 52 contacts the agitator 60 at the contact portion A and the spiral wings move along a direction D. Further discussion of contact portion A will be discussed with respect to FIG. 11. Therefore, the agitator 60 is applied an external force F1 in a direction from the agitator 60 toward the conveyance 52. Thereby, the waste toner is loosened by vibrating the end of the agitator 60 with the force F1.

Figure 10:
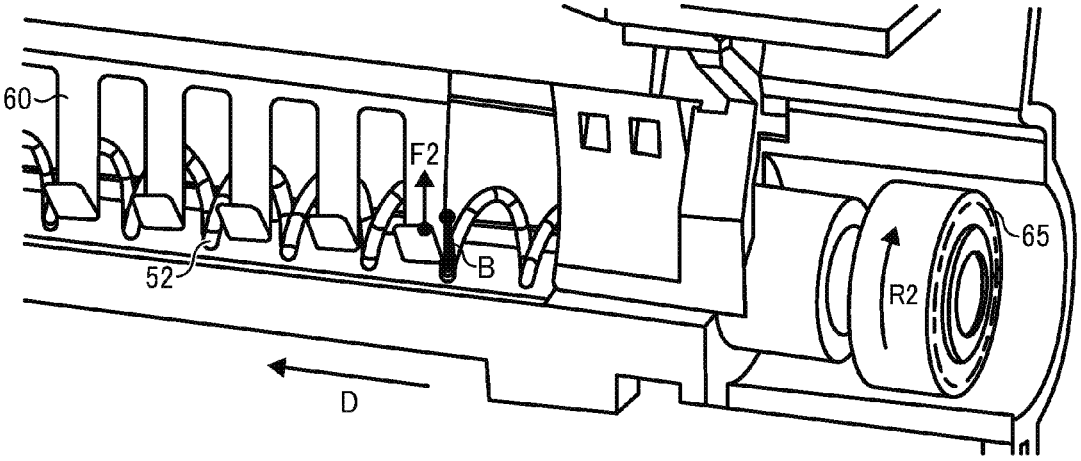
FIG. 10 illustrates a perspective view of an agitator and a conveyance under an external force acting on a contact portion between the agitator and the conveyance when the conveyance rotates in a reverse direction.

FIG. 10 illustrates a perspective view of an agitator and a conveyance under an external force acting on a contact portion between the agitator and the conveyance when the conveyance rotates in a reverse direction. In particular, FIG. 10 illustrates an external force F2 acting on a contact portion B between the agitator 60 and the conveyance 52 when the conveyance 52 rotates in the reverse direction R2.

As shown in FIG. 10, when the conveyance 52 is rotated in a rotational direction R2, which is the reverse direction of the rotational direction R1, the spiral wing of the conveyance 52 contacts to the agitator 60 at a contact portion B and moves along a direction D. Thereby, the agitator 60 is applied an external force F2 in a direction from the conveyance 52 to the agitator 60. The external force F2 acts so as to compress the agitator 60.

In this case, there is a possibility that the agitator 60 is caught in the spiral wing of the conveyance 52 and noise is generated, in addition, that the agitator 60 is damaged by involving the rotation of the conveyance 52. In typical agitators, a clutch is provided between the conveyance 52 and the gear 65 so as to stop a reverse rotation of the conveyance 52. However, adding the clutch cause increasing cost and machine size. Agitator 60, however, may be rotated in the reverse direction without being caught in conveyance 52 and without causing damage to conveyance 52 and agitator 60.

Figure 11:
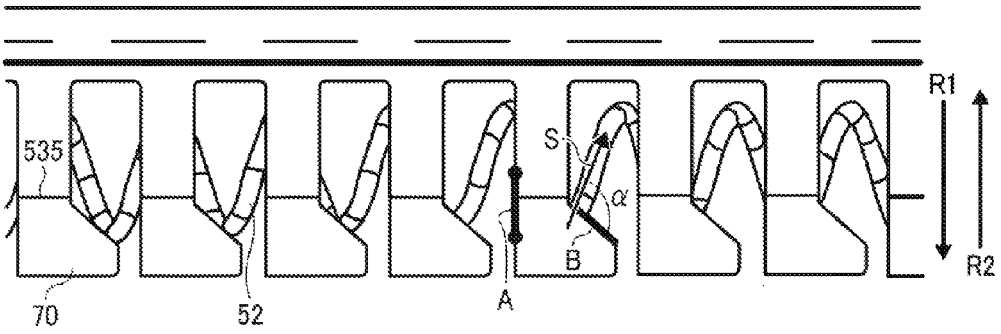
FIG. 11 illustrates a schematic view of a conveyance and an agitator.

FIG. 11 illustrates a schematic view of a conveyance and an agitator. In particular, FIG. 11 illustrates an agitator 70 that is of a plane shape. When the agitator 70 is attached to the cleaning device, the agitator 70 is bent at a bent part 535.

The agitator 70 contacts the conveyance 52 at the contact portion A of the agitator 70 when the conveyance 52 rotates in the normal direction (rotational direction R1). The agitator 70 contacts the conveyance 52 at the contact portion B of the agitator 70 when the conveyance 52 rotates in the reverse direction (rotational direction R2). A spiral wing of conveyance 52 moves along a direction S when the conveyance 52 rotates in the reverse direction, as illustrated in FIG. 11.

The agitator 70 includes a gradient α between the contact portion B and the direction S of the spiral wing of the conveyance 52. A range of the gradient α may be from 60 degrees to 120 degrees, and more preferably, the gradient α is 90 degrees. When the gradient is within 60 degrees and 120 degrees, the agitator 70 intersects approximately at a right angle to the direction S of the spiral wing of the conveyance 52 when the conveyance 52 rotates in the reverse direction, so that the agitator 70 is not caught by the conveyance 52. Such a configuration reduces the generation of noise by agitator 70.

When conveyance 52 is rotated in a rotational direction R1 the agitator 70 contacts the conveyance 52 at the contact portion A. Therefore the contact portion A has a straight shape.

In some different shape configurations of the conveyance 52, such as a different spiral direction of the conveyance 52, noise is generated at the contact portion A, and the end of the conveyance 52 is vibrated at the contact portion B. In this case, it is possible to correspond that a position of the contact portion A and the contact portion B reverse.

As described above, the agitator 70 includes a gradient α at least at one of the contact portions to the conveyance 52, which reduces the generation of noise by the agitator 70. Further, such a configuration reduces a cost and size of a cleaning device because it is not necessary to add additional components, such as a clutch. Thus, agitator 70 removes toner which accumulates the end of the cleaning member by being rotated in the reverse direction even when the conveyance rotates interlocked with photoconductor.

Figure 12:
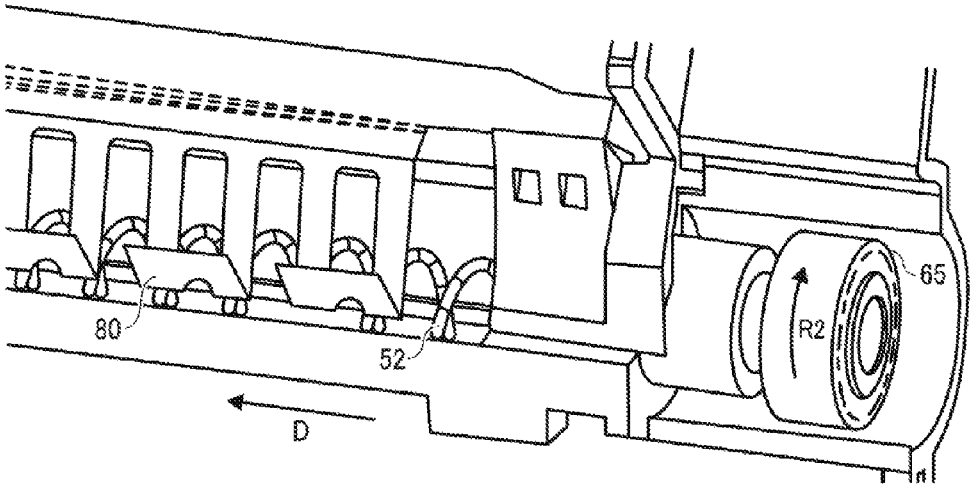
FIG. 12 illustrates a perspective view of a conveyance and another agitator.
Figure 13A:
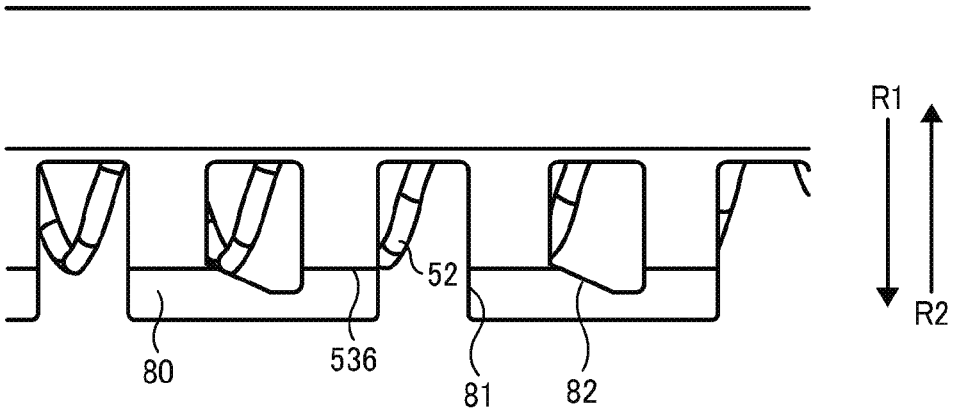
FIG. 13A illustrates a schematic view of the conveyance and the agitator of FIG. 12.
Figure 13B:
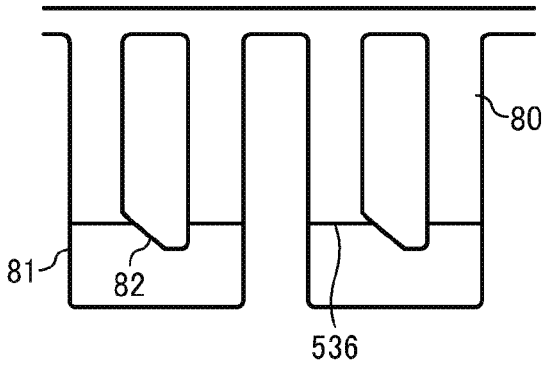
FIG. 13B illustrates a schematic view of the agitator of FIG. 12.

FIG. 12 illustrates a perspective view of conveyance 52 and another agitator, agitator 80. FIGS. 13A and 13B illustrate views of agitator 80, which includes an inclined part 82 and a development plane of the agitator 80, which is not bent at a bent portion 536.

The agitator 80 includes a straight part 81, an oblique part 82 and a bent part 536. The straight part 81 is orthogonal to an axis direction of the conveyance 52. The oblique part 82 is inclined to the axis direction of the conveyance 52. When the conveyance 52 is rotated in the rotational direction R2 by the gear 65, the spiral wing of the conveyance 52 contacts the agitator 80 at the oblique part 82. On the other side, the conveyance 52 is rotated in the rotational direction R2, which is the reverse direction of R1, and the spiral wing contacts the agitator 80 at the straight part 81.

The agitator 80 contacts the conveyance 52 at the straight part 81 when the conveyance 52 is rotated in the rotational direction R1, and the agitator 80 contacts the conveyance 52 at the oblique part 82 when the conveyance 52 is rotated in the rotational direction R2. In this embodiment, since the agitator 80 contacts the spiral wing of the conveyance 52 in approximately orthogonal direction, the agitator 80 is not caught by the conveyance 52 a generation of noise by the agitator 80 is reduced.

As illustrated in FIGS. 13A and 13B, ends of the arm members of the agitator 80 may be connected. In the other words, the arm members of the agitator 80 are connected at the end thereof. Such a configuration enhances an agitating ability because an agitated area of the agitator 80 is increased.

Figure 14A:
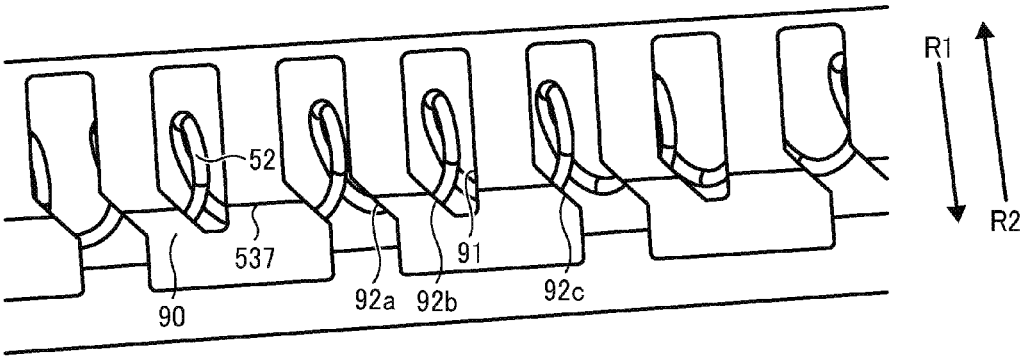
FIG. 14A illustrates a schematic view of the conveyance and a modified agitator of FIG. 12.
Figure 14B:
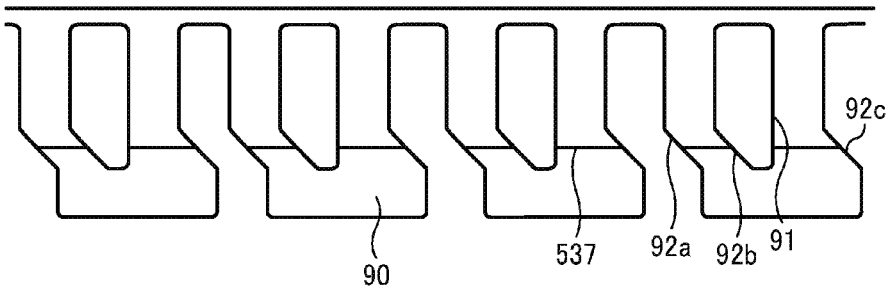
FIG. 14B illustrates a schematic view of the agitator of FIG. 14A.

FIGS. 14A and 14B illustrate another variation of an agitator. While the agitator 80 shown in FIG. 13 includes one oblique part at connected end, the agitator 90 illustrated in FIGS. 14A and 14B includes a plurality of oblique parts. In particular, three oblique parts are provided at a pair of end portion of the agitator 90. That is, the agitator 90 includes a straight part 91, a first oblique park 92*a*, a second oblique park 92*b*, a third oblique part 92*c* and a bent part 537.

When the conveyance 52 rotates in the rotational direction R2, the agitator 90 contacts the spiral wing of the conveyance 52 at the second oblique part 92*b* and the third oblique part 92*c*. Thereby, the agitator 90 is not caught by the conveyance 52 because the agitator 90 contacts the spiral wing of the conveyance 52 in an approximately intersecting direction when the conveyance 52 rotate in the reverse direction. Such a configuration reduces a generation of the noise.

In addition, the agitator 90 includes the first oblique part 92*a*. Thereby, a processability of the agitator 90 is increased because a distance between the first oblique 92*a* and the third oblique 92*c*, which is next to first oblique 92*a*, is increased. Furthermore, the agitator 90 includes the straight part 91, which is a length in the longitudinal direction of the end side of the agitator 90. When straight part 91 is of a large length, an area of an end side of agitator 90 is increased and a strength of the agitator 90 is increased.

The agitator 90 further includes a gradient side (i.e., oblique part) at a part of contact portion to the conveyance 92, and it is possible to suppress a generation of noise when the conveyance 52 rotates in the reverse direction. In addition, processability and strength are enhanced by effectively combing the straight part and the oblique part of the end of the agitator 90.

Therefore, agitator 90 removes toner which accumulates at end of the cleaning blade when the photoconductor rotates in the reverse direction even when the conveyance rotates in conjunction with the photoconductor.

These embodiments are but examples. Moreover, variations and modifications may be made without departing from the scope of the present disclosure.

What is claimed is:

1. A cleaning device comprising:
a cleaning member to clean toner on an image bearer;
a toner conveyor that rotates to convey toner cleaned by the cleaning member; and
an agitator that includes an arm member, the arm member including at least a first surface and a second surface that intersect at a bent portion, wherein
the bent portion is in contact with the toner conveyor, and
the agitator vibrates due to the rotation of the toner conveyor.

2. The cleaning device according to claim 1, further comprising:
a seal member disposed between the cleaning member and the image bearer, wherein
an end of the agitator is disposed below an upper end of the seal member.

3. The cleaning device according to claim 1, wherein
the agitator includes a plurality of arm members, and
a first end of a first arm member of the plurality of arm members is attached to a second end of a second arm member of the plurality of arm members.

4. The cleaning device according to claim 3, wherein
when the toner conveyor rotates in a first direction, the toner conveyor contacts an inclined portion of a first arm member, and
when the toner conveyor rotates in a second direction opposite of the first direction, the toner conveyor contacts a vertical portion of the first arm member.

5. The cleaning device according to claim 1, wherein
the agitator includes a plurality of arm members, and
each arm member includes a first surface and a second surface that intersect at a bent portion.

6. The cleaning device according to claim 1, further comprising:
a restrictor to restrict a position of the agitator.

7. The cleaning device according to claim 1, wherein
the agitator includes an end side arm member including first and second surfaces intersecting at an end side bent portion, and
an end of the agitator faces the toner conveyor from the end side bent portion.

8. The cleaning device according to claim 1, further comprising:
a weight that is attached to the agitator.

9. The cleaning device according to claim 1, further comprising:
a reinforcing member that is attached to the bent portion of the arm member.

10. The cleaning device according to claim 1, wherein
the arm member that includes a inclined portion inclined along an axis direction of the conveyor, and
the inclined portion contacts the conveyor.

11. The cleaning device according to claim 10, wherein
the agitator includes a plurality of arm members, and
each arm member of the plurality of arm members includes an inclined portion.

12. The cleaning device according to claim 10, wherein
the agitator includes a plurality of arm members,
a first end of a first arm member of the plurality of arm members is attached to a second end of a second arm member of the plurality of arm members, and
the first arm member has two inclined portions and the second arm member has one inclined portion and one straight portion which is orthogonal to the axis direction.

13. The cleaning device according to claim 10, wherein the bent portion is at the inclined portion.

14. The cleaning device according to claim 1, wherein the conveyor rotates when interlocking with the image bearer.

15. A process cartridge that is detachably coupled to an image forming apparatus, the process cartridge comprising:
a photoconductor to form an image on a surface thereof;
a charger to charge the photoconductor;
a developing device to develop the image on the photoconductor charged by the charger; and
the cleaning device according to claim 1.

16. The process cartridge according to claim 15, wherein the photoconductor rotates so that a surface of the photoconductor is made to be closer to the cleaning device.

17. An image forming apparatus comprising:
an image bearer; and
the cleaning device according to claim 1.

18. The cleaning device according to claim 1, wherein the cleaning member is a blade that cleans the toner on the image bearer.

19. A cleaning device comprising:
a toner conveyor that rotates to convey toner cleaned by a cleaning member; and
an agitator that includes an arm member, the arm member including at least a first surface and a second surface that intersect at a bent portion, wherein
the bent portion is in contact with the toner conveyor, and
the agitator vibrates due to the rotation of the toner conveyor.

20. A cleaning device comprising:
a cleaning member to clean toner on an image bearer;
a toner conveyor that rotates to convey toner cleaned by the cleaning member; and
an agitator that includes an arm member, the arm member including a first surface and an inclined portion that contacts the conveyor and is inclined along an axis direction of the conveyor, the first surface and the inclined portion intersecting at a bent portion, wherein
the bent portion is in contact with the toner conveyer, and
the agitator vibrates due to the rotation of the toner conveyor.

* * * * *